US006665789B1

(12) United States Patent
Stecker, Sr.

(10) Patent No.: US 6,665,789 B1
(45) Date of Patent: Dec. 16, 2003

(54) SURFACE OR UNDERWATER DIVE VEHICLE

(76) Inventor: David W. Stecker, Sr., 23W540 Bryn Mawr, Roselle, IL (US) 60172

( * ) Notice: Subject to any disclaimer, the term of this patent is extended or adjusted under 35 U.S.C. 154(b) by 0 days.

(21) Appl. No.: 10/201,393

(22) Filed: Jul. 23, 2002

Related U.S. Application Data

(60) Provisional application No. 60/307,232, filed on Jul. 23, 2001.

(51) Int. Cl.[7] ..... B63C 11/46
(52) U.S. Cl. ..... 711/315; 114/242; 440/6
(58) Field of Search ..... 440/6; 114/315, 114/242

(56) References Cited

U.S. PATENT DOCUMENTS 4,864,959 A 9/1989 Takamizawa et al.
4,996,938 A 3/1991 Cameron et al.
5,101,128 A * 3/1992 Veronesi et al. ..... 310/54
5,376,027 A * 12/1994 Hergenrather ..... 440/38
5,379,714 A 1/1995 Lewis et al.
6,065,419 A 5/2000 Stecker, Sr.

OTHER PUBLICATIONS

Derwent search for underwater vehicles (10 pages).

* cited by examiner

*Primary Examiner*—Jesus D. Sotelo
(74) *Attorney, Agent, or Firm*—Barnes & Thornburg

(57) ABSTRACT

An electric motor for powering a submersible vehicle under water is disclosed. The motor has a housing with resilient seals for resisting the passage into the housing and motor of surrounding seawater. A liquid substantially fills all voids in the motor and housing, so that even under substantial external pressure at substantial depths under surrounding water the liquid within the motor and motor housing voids will support the seals against failure and prevent the surrounding water from leaking into the motor and motor housing. The vehicle has a housing within which there is a void which is substantially filled with a liquid There is an opening in the housing wall and a resilient member such as a flexible, resilient tube or diaphragm is disposed within the opening and is in fluid communication with both the interior and exterior of said housing, so that the pressure on the interior and exterior of said housing will be equalized.

17 Claims, 2 Drawing Sheets

SURFACE OR UNDERWATER DIVE VEHICLE

This application is based upon and claims the priority of U.S. Provisional application No. 60/307,232 filed Jul. 23, 2001.

BACKGROUND OF THE INVENTION

This invention relates to a water vehicle of the type which may be used on the surface or under water, either manned or unmanned, for propelling the vehicle to underwater locations, and more particularly to a powered underwater vehicle in which the pressure is substantially equalized in certain parts of the vehicle as the vehicle descends to greater depths in the water. The invention provides a way of preventing water from entering into the cavities of components, such as a motor, motor housing and switches which may be surrounded by water under great pressure at, for example, dive depths.

This invention is an improvement in an underwater vehicle such as the vehicle described and claimed in my U.S. Pat. No. 6,065,419 dated May 23, 2000 and entitled Underwater Dive Vehicle and in my pending U.S. patent application Ser. No. 09/909,568 filed Jul. 20, 2001. In that patent and pending application there is disclosed and claimed a dive vehicle which employs a flexible and resilient gas filled buoyancy element which may be in the form of a resilient bladder or a closed cell resilient sponge material, and may incorporate a plurality of rigid, foamed substantially incompressible second buoyancy elements that may be selectively attached to or removed from the vehicle to adjust buoyancy and thereby achieve neutral buoyancy according to the weight of the vehicle and its load and/or according to the buoyancy of the waters surrounding the vehicle.

Small powered underwater dive vehicles for taking one or two divers to underwater locations usually comprise a motor having a drive shaft which is operably connected to a propeller, a battery for energizing the motor and one or more control switches for selectively energizing the motor. Such devices are illustrated and described, for example, in U.S. Pat. No. 5,379,714, U.S. Pat. No. 4,864,959 and U.S. Pat. No. 4,996,938. Such vehicles, however, have encountered problems of leakage which is a particular problem when the vehicle is taken to substantial depths where the pressure may be several atmospheres. For every 10 meters of descent in sea water, an additional atmosphere of pressure is placed on the vehicle and its parts. Thus, at a depth of 30 meters or approximately 100 feet, there are 4 atmospheres of pressure, and the pressure corresponding increases as greater depths are attained. Underwater dive vehicles should be designed to withstand 15 atmospheres of pressure or the pressure that would be encountered at a depth of 500 feet.

The greater the pressure, the more stress there is on the seals which are in place to keep water out of such areas as the motor, the motor housing and switches. U.S. Pat. No. 4,864,959 recognizes this problem and is directed to detecting leaks of sea water into the battery or motor compartments of underwater dive vehicles. That patent also suggests that water absorbing sheets be stuffed around mechanical parts and the battery and clutch compartments. Another moisture detection system for an underwater dive vehicle is disclosed in U.S. Pat. No. 4,996,938.

In an underwater vehicle it is desirable, if not essential not just to detect, but to prevent the sea water surrounding the vehicle from entering the sealed cavities of the vehicle, such as those cavities in the motor housing, motor and switches.

My U.S. Pat. No. 6,065,419 suggests filling those cavities with a non-conductive and non-corrosive liquid, such as silicone grease or transformer oil. Since liquids are substantially non-compressible, seals which are positioned to prevent the entry of sea water into the cavities of the vehicle will be supported by the liquid in the interior of the cavity and will not be distorted by the pressure of the sea water acting through the seal against a compressible and thus non-supporting gas within the cavity. In other words, with liquid in the interior of the cavity, the seal will not be moved inwardly to an extent which would normally cause it to distort or stress and permit leakage of sea water into the cavity.

Even though the liquid within the cavities may not be perceptively compressible, there may be a difference in the external pressure at substantial dive depths and the initial internal pressure within the cavities, particularly those cavities which are large in size and may have minute entrapped gas. These internal and external pressures tend to equalize causing the internal pressure to increase to that of the ambient pressure at dive depths. Then when the vehicle surfaces the internal pressure within the cavities tends to again equalize to the atmospheric pressure at sea level, with the result of possible inward leakage at dive depths and outward leakage at the surface.

The protection of the motor from the entry of sea water at dive depths presents a unique problem. Heretofore, the entire effort was aimed at improving the seals to keep sea water out of the motor. These efforts have not been uniformly successful and this invention takes a completely different approach to this problem.

It is thus an object of the present invention to provide a solution to the water leaks which have heretofore plagued motors other housed operating equipment such as that used in underwater dive vehicles by so constructing the vehicle, motor or other housed equipment that the water tight seals are not placed under stress even when the unit is submerged to depths of several hundred feet.

It is also the object of this invention to provide a modified electric motor which is unaffected by surrounding water even under external pressures encountered at substantial dive depths.

SUMMARY OF THE INVENTION

The invention may be incorporated in any underwater vehicle, motor, or housed equipment. One type of under water vehicle is disclosed in U.S. Pat. No. 6,065,419 which includes a selectively energizable propulsion unit for forcibly driving said vehicle through the water, with the propulsion unit including at least one motor and a housing for the motor. The vehicle may contain buoyancy means such as a resilient gas filled buoyancy element and/or a rigid buoyancy element.

The propulsion unit may include an electric motor or motors which would normally have an output shaft on which is mounted a propeller. An electric storage battery supplies electric current for driving the motor. A manually operable switch, which may be in the form of a push-button or joystick or turn switch or toggle switch would permit the motor to be selectively energized by the diver-operator.

It is preferred that all electrical terminals, such as the terminals for the battery and the motor or motors be encased in a waterproof epoxy resin, so that the sea water will not come into contact with these terminals and cause corrosion. It is preferred that the terminals and battery connections be protected by epoxy as described and illustrated in my aforementioned pending application Ser. No. 09/909568.

Means is provided for preventing water from entering sealed cavities of the vehicle, such as those cavities in the motor or switches. This is accomplished by filling those cavities with a liquid, such as water or transformer oil or a combination of two or more liquids. Since liquids are substantially non-compressible, seals which are positioned to prevent the entry of sea water into the cavities of the vehicle will be supported by the liquid in the interior of the cavity and will not be distorted by the pressure of the sea water acting through the seal against a compressible and thus non-supporting gas within the cavity. In other words, with liquid in the interior of the cavity, the seal will not be moved inwardly to an extent which would normally cause it to distort or stress and permit substantial leakage of sea water into the cavity.

One feature of this invention is the provision of a mechanism for preventing the passage of liquid either into or out of a liquid filled cavity when there are variations between the internal and exterior pressures at various depths or at the surface. This prevents the intrusion of sea water inwardly into the housing at diving depths and also prevents any "blow-back" or outward leaking of the liquid within the housing when the vehicle surfaces and the external pressure is less.

This additional protection can be obtained by filling a cavity, such as that of the motor housing, with a non compressible liquid and providing a flexible and resilient tube, bladder, or diaphragm which is positioned between and is in fluid communication with both the liquid within the cavity and the surrounding water (or air) external of the cavity. This will tend to equalize the pressure inside and outside of the housing, thus protecting against any leakage into or out of the housing caused by a differential in pressure between that within the housing and that outside the housing. This feature can be employed with other sealed cavities of the vehicle.

Another feature of this invention is the protection of the motor from the entry of sea water in a unique way. The prior attempts at preventing water from leaking into the motor have centered around improving the seals. This invention takes a radically different approach. Since the seals will distort very little if there is liquid on both sides of the seal, it has been found that filling the motor with a liquid having low viscosity approaching that of water will prevent the entry of sea water past the seals and into the motor at all dive depths. The preferred liquid is water and the preferred water is distilled water. When the motor is filled with distilled water it will operate efficiently and eliminate the possibility of having surrounding sea water enter the motor even at substantial depths and under substantial pressures.

Pure water, i.e., water with little or no dissolved or dispersed minerals or other substances which would increase the conductivity of the water also works well as a , cavity-filling liquid. Distilled water or pure water will allow the electric motor to operate for about 70 hours, after which the motor can be opened for the installation of new brushes and replacement of the water. If antifreeze is added, the motor can be operated in freezing temperatures. Because of the low viscosity of water, there is little resistance on the moving parts of the motor, such as the armature. Less pure water can also be used, but the higher the dissolved or dispersed mineral or conductive particle content the greater the tendency to conduct and corrode, thereby lessening the running time of the motor. Liquids such as pure or distilled water has an additional advantage of cooling the motor.

DETAILED DESCRIPTION OF THE PREFERRED EMBODIMENTS

Figure 1:
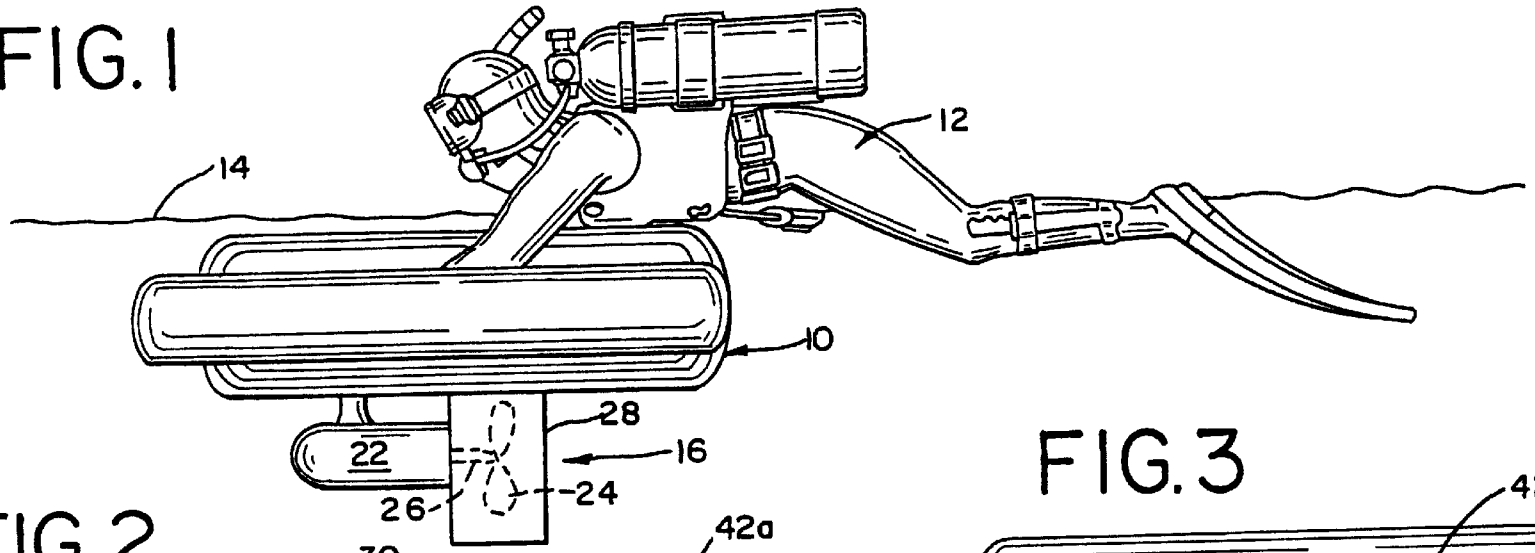
FIG. 1 is a side elevational view of an under water dive vehicle constructed in accordance with one embodiment of the invention, showing a diver on the vehicle at the surface of the water.

In FIG. 1 there is illustrated an underwater dive vehicle 10 constructed in accordance with this invention. The dive vehicle is being used by a diver 12 and in this figure it is illustrated at the surface of the water 14. Although described as a dive vehicle, it will be appreciated that the vehicle may also be used on the water surface to transport a diver to a dive location or for snorkeling and is extremely beneficial for the disabled or physically impaired.

Figure 2:
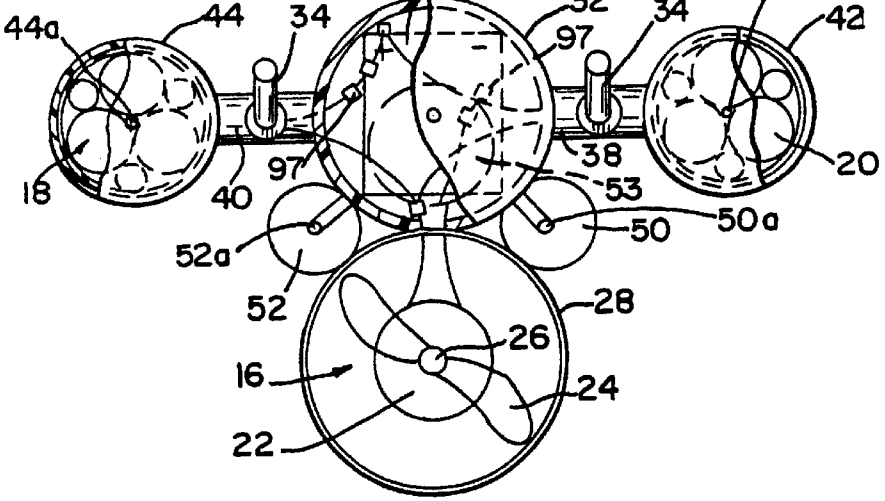
FIG. 2 is an end elevational view of the vehicle with portions of the buoyancy chambers and propulsion unit and battery compartments cut away to show the interiors thereof.

As best illustrated in FIG. 2, the dive vehicle comprises a selectively energizable propulsion unit 16 for forcibly driving the vehicle through the water. The vehicle also includes buoyancy means in the form of at least one and preferably two outwardly disposed gas filled compressible buoyancy elements 18 and 20 and one and preferably several substantially incompressible foamed buoyancy elements.

The selectively energizable propulsion unit preferably includes a battery operated electric motor 22, incorporating a motor which drives a propeller 24 through a suitable and well-known connections such as a drive shaft 26. A standard battery driven trolling motor is quite satisfactory. A suitable protection cage 28 surrounds the propeller 24. While described in connection with a propeller driven vehicle, the invention may be advantageously used in connection with any motor or housed equipment, such as a pump, where the motor or housed equipment is used under water and may be subjected to very high external pressures.

The unique propeller guard has a brass cage 11 to detour fingers, yet let the thrust of the water through. The brass ribs 29 on the front keep weeds and other objects from being sucked into the propeller by diverting them away. A wide sled type runner 27 on the front allows the unit to slide across the muddy bottom or rock and aquatic life without doing damage to the propeller, vehicle and aquatic life. This guard could be mounted on a boat with an inboard motor or on an outboard motor to protect the propeller or anything that it may run across such as manatees and swimmers. The sides of the propeller guard must be open to allow enough water to the propeller to achieve maximum thrust, and the tips of the propeller must be far enough away form the sides of the propeller guard surround so that the water will not cavitate.

A suitable sealed nickel-cadmium, dry cell or gel cell lead acid battery 30 housed within a central body or housing 32 provides the electrical energy for the motor 22 of the propulsion unit 16. The battery 30, which preferably has unique watertight connections later described, is selectively electrically connected to the propulsion unit 16 by means of suitable switches 34 and 36 which may be in the form of joysticks of the kind commonly used to operate underwater vehicles of this type.

Figure 3:
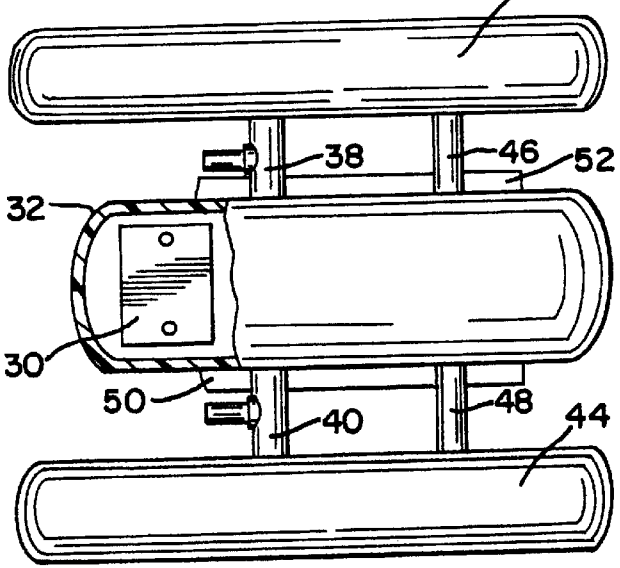
FIG. 3 is a top plan view of the vehicle with a portion of the battery compartment cut away to show the interior thereof.

In the vehicle illustrated in FIGS. 1, 2 and 3, the motor 22 of the propulsion unit 16 includes a motor mounted below the tubular central housing 32, and the drive shaft 26 extends rearwardly to operate the propeller 24. The switches 34 and 36 are mounted on hollow, tubular connecting arms 38 and 40 which connect the central housing 32 to outwardly disposed buoyancy element housings 42 and 44 on either side of the central housing 32, and a similar pair of rearwardly disposed connecting arms 46 and 48 also connect the rearward portion of the central housing 32 to the rearward portion of the buoyancy element housings 42 and 44 on either side thereof, as best shown in FIG. 3.

Compressible buoyancy elements 18 and 20 preferably are disposed within the buoyancy element housings 42 and 44, with each of the buoyancy element housings being open preferably at both ends so that the water may enter the housing and contact the compressible buoyancy elements when the vehicle is in the water. The compressible buoyancy elements 18 and 20 consist of elements which are substantially filled with air or other gas and which are highly resilient, compressible and flexible. Each buoyancy element may, for example, be a rubber or neoprene bladder which is filled with air, or it may be a very resilient and compressible closed cell foamed material such as foamed polyurethane, polyethylene, silicon sponge rubber, PVC, neoprene sponge rubber or the like. The material should be very resilient and compressible. Compressibility of about 25% at pressures between about 2.5 psi and 14 psi is satisfactory. The density should be as low as possible. Alternatively, the buoyancy elements may be a combination of closed cell sponge material and inflatable bladders.

In FIG. 2 the forward openings 42*a* and 44*a* are provided in the buoyancy element housings 42 and 44 respectively. Similar openings are provided in the rear of these housings with the openings being such that the water may freely enter the housings 42 and 44. Preferably, the openings should just be large enough to assure the entry of water into the housings and to permit draining. Thus, the compressible buoyancy elements 18 and 20 are always subject to the pressure of the water at the depth at which the vehicle is being operated. In the case of a closed cell sponge such as neoprene sponge rubber, gases are entrapped in the discrete closed voids and when the vehicle is submerged, the buoyancy element will be subject to the pressure of the water which will tend to compress the entrapped gas in the buoyancy element, with the pressure increasing as the depth increases. When the vehicle is brought to the surface the water may be easily drained from the buoyancy element housings 42 and 44 through the forward openings 42*a* and 44*a* or the rearward openings (not shown).

The buoyancy may be adjusted, if desired. For such adjustment, two rigid, substantially incompressible buoyancy elements 50 and 52 are provided, as shown in FIGS. 2 and 3. These may be contained within housings such as housing 42 and 44 that are open at both ends and may be removably connected the vehicle. These incompressible foam buoyancy elements may be in sections or pieces which can be individually added or removed and they may be combined with compressible buoyancy elements. This permits the diver to adjust the buoyancy by adding or removing rigid buoyancy elements and/or compressible buoyancy elements. This may be desirable if, for example, there is excessive weight on the vehicle such as when two divers are using the vehicle or heavy objects are being carried or mounted on the vehicle. It is preferred that the incompressible foam buoyancy elements provide neutral buoyancy of the vehicle at the surface.

At the surface of the water the compressible buoyancy elements 18 and 20, consisting of the bladder or foamed material or combination of bladder and foamed material, will contain sufficient entrapped air so that the vehicle will remain buoyant on the surface or at the surface even if the vehicle were unattended. However, as the vehicle is driven to greater depths, the gas in the compressible buoyancy elements 18 and 20 will compress and ultimately the unit will become negatively buoyant because the air in these elements will be compressed and the buoyancy elements will become very small. At this point the rigid and incompressible foam buoyancy elements would take over and permit the vehicle to become neutrally buoyant at the desired depth even when the motor is not running.

In order to further offset the weight of the vehicle, the motor and the battery, the interior of the central housing 32 which contains the battery 30 may have an additional compressible buoyancy element 53. The central housing has openings to allow the water into the housing to contact the buoyancy element 53 in the same manner as the buoyancy housings 42 and 44.

As disclosed in my pending application Ser. No. 09/909568 it is preferred that all of the wiring including the terminals of the battery be coated with a waterproof epoxy preventing water from contacting the terminals or bare wires, and that all voids be filled with a non-compressible liquid. Thus, even though the interior of the central housing is open to the water, the water will not contact the battery terminals within the central housing.

As also disclosed in that application, it is preferred that all voids containing moving parts be filled with a non conductive liquid oil, such as transformer oil or a silicon grease, which is non-compressible at operational depths. Such liquid may be used to fill, for example, voids in surrounding housings and those voids within or surrounding the moving parts of such components as switches, where rapid movement is not likely.

The protection of the motor from the entry of sea water at dive depths presents a unique problem. Heretofore, the entire effort was aimed at improving the seals to keep sea water out of the motor. These efforts have not been uniformly successful and this invention takes a completely different approach to this problem. In a motor the non-compressible liquid should be of very low viscosity because the motor is rotating at a high rate of speed and this speed of rotation should not be unduly impeded.

It has been found that by filling the cavities of the motor, including the cavities surrounding the armature, the commutator and brushes, with a liquid such as water the motor will still operate effectively and efficiently, while preventing any intrusion of sea water into the motor even at substantial depths. It is preferred that distilled water be used, because it is free of contaminants. Pure water, i.e., water with a very low mineral content, also works well as a cavity filling liquid. Although not preferred, other less pure water can be used depending upon amount of dissolved or dispersed minerals or other conductive materials in the water. It has been found that with distilled or very pure water the electric motor or motors will operate satisfactorily for a period of time about 70 hours. With other less pure water the operating time will be less, depending upon the contaminants in the water. If antifreeze is added, the motor or motors can be operated in freezing temperatures. Because of the viscosity of water, it has little resistance on the moving parts of the motor. Water has the advantage of cooling the motor and many substances can be added to water like antifreeze, non-foaming soaps and detergents and many other compounds.

Other liquids may be used to fill the voids in the motor, though these are not preferred. To give an example of the wide variety of other liquids that will work to one degree or another are mineral oil, or various fruit (lemon or lime) juices.

With the voids in the motor 22, for example, filled with a non-compressible liquid such as distilled water, the seals between sections of the motor will have minimum strain placed upon them because the liquid on the interior of the housing is non-compressible and will resist inward movement of the seals even under severe external pressures such as those encountered at diving depths. If air was entrapped within the motor, such as in the space surrounding the armature of the motor, this would be extremely compressible, would not resist movement of the seals. This would place an enormous strain upon the seals in order to keep the sea water out at operational depths.

Figures 4, 4A:
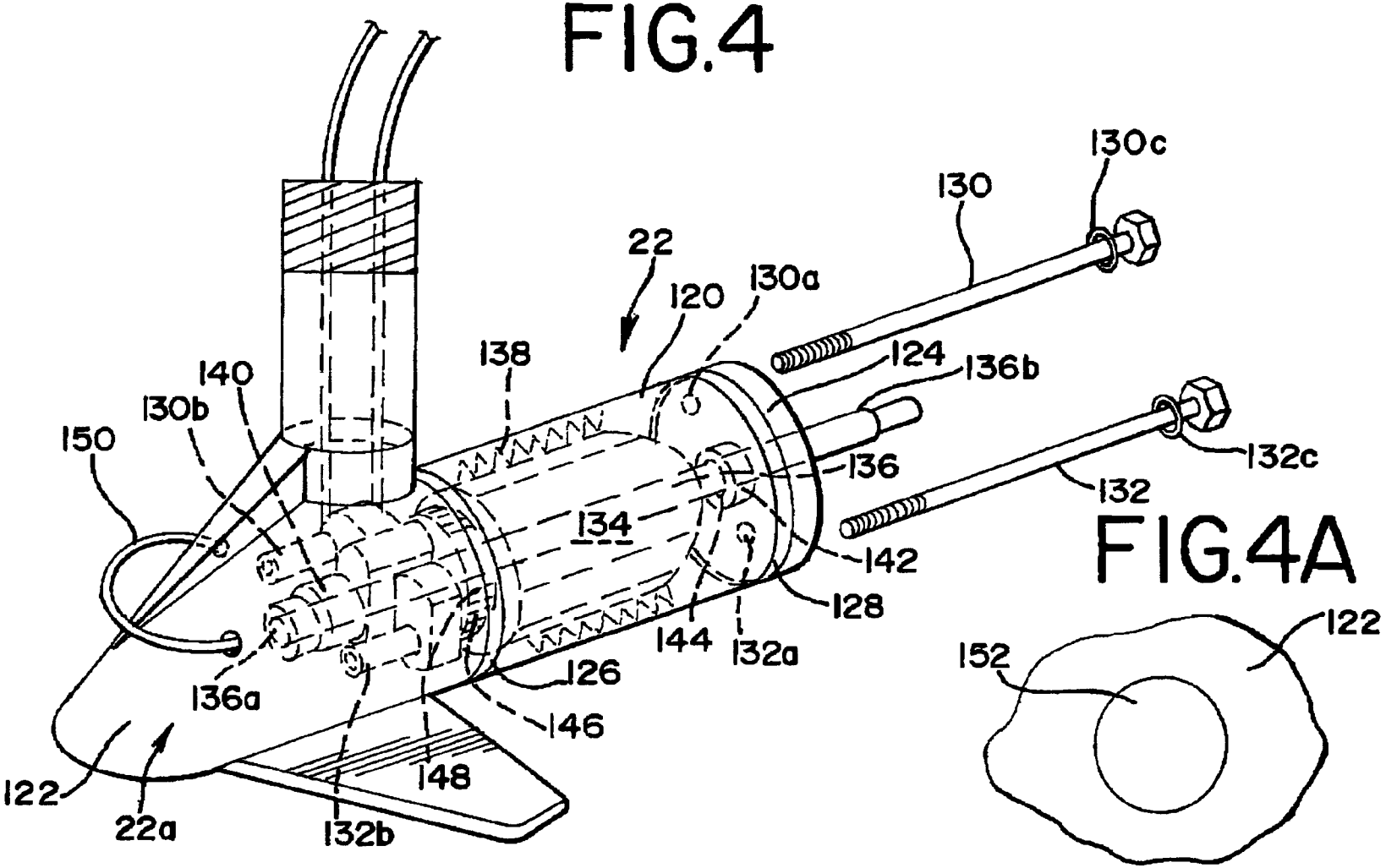
FIG. 4 is a perspective view of the motor partially broken away to show the interior and a mechanism which may be employed to achieve equalization of pressures inside and outside of the motor.
FIG. 4A is an enlarged plan view of an alternative mechanism which may be employed to achieve equalization of pressures inside and outside of the motor.

In FIG. 4 there is shown schematically a motor 22 for the propulsion unit 16. The motor includes a housing 22*a*. The housing has a cylindrical central body 120, a bullet shaped forward end or nose 122 and a rearward end cap 124. A circular seal 126 is placed between the nose and the central body of the housing, and another circular seal 128 is placed between the central body of the housing and the end cap. At least two long connecting bolts 130 and 132 extend through corresponding holes 130*a* and 132*a* in the housing end cap 124 and threadedly engage internally threaded portions 130*b* and 132*b* of the housing nose and are tightened to bring the end cap 124 and nose 132 into sealing engagement with the cylindrical central body 120 of the motor housing 22*a*. Seals 130*c* and 132*c* provide a seal between the bolts and the housing end cap when the bolts are tightened.

The interior of the motor 22 in this example is open to the interior of the housing 22*a*. The motor is preferably a standard trolling motor, which includes an armature 134, having a shaft 136 which is journaled for rotation relative to stationary windings 138. The forward end 136*a* of the armature shaft 136 is journaled in a forward bearing 140 in the housing nose 122, and the rearward end 136*b* of the armature shaft is journaled in a rearward bearing 142 in the housing end cap 124. The rearward end 136*b* of the armature shaft is surrounded by a seal 144 at its passage through the end cap 124 for preventing surrounding sea water from seeping into the motor around the that end of the armature shaft. The rearward end of the armature shaft extends beyond the end cap 124 and serves as the propeller drive shaft. Extending forwardly from the armature 134 on the forward end 136*a* of the armature shaft is the commutator 146, and brushes 148 are positioned to engage the commutator segments as the armature and commutator rotate, in the standard and well known arrangement.

The motor housing is thus sealed against the passage of liquid into and out of the housing. However, means is provided for filling all voids in the motor and motor housing with liquid, preferably distilled or pure water. This may be easily done through the holes 130*a* and 132*a* in the housing end cap. The long bolts are first removed and the water or other liquid is inserted into one of the holes with the other hole being left open for the exiting of air which is being replaced by the liquid. Several additional bolts (not shown) may be employed to hold the housing parts together in sealing engagement with one another during the filling of the motor and housing with water or other liquid. Alternatively, separate fill holes may be provided with removable screw caps. While are described and illustrated in the housing end cap, the fill hole or holes may be at any point in the motor housing. It, or they, may be in the nose 122, for example, which would be ideal for a single fill hole, because it would be the highest point of the motor housing 22*a* when the housing is vertically oriented. The liquid will flow into all voids and recesses in both the motor and the motor housing. When the motor has been in use for a period of time (usually about 70 hours when the liquid is distilled water) the nose 122 of the motor housing is removed permitting the liquid to be removed and the brushes 148 to be changed if necessary.

In the nose 122 of the housing of this embodiment there is a resilient flexible member in the form of a tube 150 which extends from one side of the nose to the other, exterior of the housing 22*a*, and this tube is in fluid communications at both ends with the interior of the housing nose. The tube may, for example, be made of a rubber-like material or neoprene. Thus when liquid is inserted into the motor and surrounding housing as previously described, the liquid will enter this tube. As the vehicle submerges the resilient tube will be subjected to the pressure of the surrounding sea water. Due to the resilience of the tube the pressure on the inside of the housing and motor will be equal to that of the surrounding sea water eliminating any inward pressure on the seals of the housing and motor. As the vehicle moves toward the surface the resilience of the tube will cause the pressure within the housing and motor to equal that of the surrounding water or air and this will eliminate any outward pressure on the seals and thus any "blow-back" (outward leaking) of the water in the interior of the housing and motor.

The tube 150 is sealingly connected at both ends to the interior of the housing nose so that the liquid may readily flow into the hose and there will be no air blocked in the hose. For accomplishing this pressure equalizing of the interior and exterior of the housing any resilient, flexible structure will do, such as a resilient, flexible diaphragm or bladder 152 (See FIG. 4A), provided one side is exposed to the outside of the housing and motor and the other side is exposed to the inside of the housing. The structure should be sealed to the housing so that liquid cannot pass through or around the structure and the pressure equalizing effect is achieved by the resilient nature of the structure.

When filling the motor and housing with a liquid it is sometimes difficult to get all of the air out of all of the voids. Thus there can be pockets of entrapped air. Since gas molecules expand and compress as pressures increase and increase, respectively, the resilient, flexible tube, diaphragm or bladder serves as a flex point or expansion-compression mechanism to accommodate this expansion or contraction while equalizing the pressure within and without the motor housing and motor.

While the resilient, flexible pressure equalizing structure has been described in connection with the motor housing and motor, it will be appreciated that this structure will work in connection with any liquid filled cavity to equalize the pressures within and without the cavity.

The foregoing description of the preferred embodiment has been provided only as an example of one embodiment of the invention. It will be readily apparent to those skilled in the art that a number of modifications can be made in the invention without departing from the spirit and scope of the invention as hereafter claimed.

I claim:

1. An electric motor for powering a submersible vehicle under water, a housing for said motor having resilient seals for resisting the passage into the housing and motor of water surrounding the motor and housing, a liquid substantially filling all voids in said motor and housing including the electrical windings, whereby even under substantial external pressure at substantial depths under surrounding water the liquid within the motor and motor housing voids will support the seals against failure and prevent the surrounding water from leaking into the motor and motor housing.

2. The electric motor of claim 1 wherein the liquid is water.

3. The electric motor of claim 2 wherein the water is substantially pure water having substantially no dissolved minerals therein.

4. The electric motor of claim 2 wherein the water is distilled water.

5. The electric motor of claim 1 wherein said motor housing has at least one hole for introducing liquid into the interior of the housing, and means is provided for sealingly closing said hole.

6. The electric motor of claim 5 wherein said motor housing has a tapered end and at least one fill hole in said tapered end, whereby when the motor housing is oriented with said tapered end at the top, the housing may be easily filled with water and air voids can be minimized.

7. The electric motor of claim 1 wherein said motor housing has at least two holes and means for closing said holes, one of the holes serving as a fill hole for introducing liquid into the interior of the motor housing and motor and the other hole for permitting air to exit, preventing entrapped air within the housing and motor.

8. An electric motor for powering a submersible vehicle under water, a housing for said motor having a wall and resilient seals for resisting the passage through said wall into the interior of said housing and motor of water surrounding the motor and housing, a liquid substantially filling all voids in said motor and housing including the electrical windings, said wall having an opening and a resilient member in sealing engagement with said housing opening and in fluid communication with both the interior and exterior of said housing, whereby the pressure on the interior and exterior of said housing will be equalized.

9. The electric motor of claim 8 wherein the liquid is water.

10. The electric motor of claim 9 wherein the water is substantially pure water having substantially no dissolved minerals therein.

11. The electric motor of claim 9 wherein the water is distilled water.

12. In a submersible under water vehicle having at least one housing with a wall separating the interior of said housing from ambient water surrounding said housing and one or more voids on the interior of said housing, the improvement comprising, a liquid substantially filling all said housing voids, an opening in said housing wall and a resilient member in sealing engagement with and completely covering said housing opening and the interior of said resilient member being in fluid communication only with said liquid on the interior and the exterior of said resilient member being in fluid communication only with the ambient water on the exterior of said housing, whereby the pressure on the interior and exterior of said housing will be equalized.

13. In a submersible underwater vehicle having at least one housing with a wall separating the interior of said housing from ambient water surrounding said housing and one or more voids on the interior of said housing, the improvement comprising, a liquid substantially filling all said housing voids, an opening in said housing wall, and a resilient tube in sealing engagement with said housing opening the interior of said tube being in fluid communicate only with the interior of said housing, whereby the pressures on the interior and the exterior of said tube being in fluid communication only with the exterior of said housing exterior of said housing will be equalized.

14. In a submersible underwater vehicle having at least one housing with a wall separating the interior of said housing from ambient water surrounding said housing, and one or more voids on the interior of said housing, the improvement comprising, a liquid substantially filling all said housing voids, an opening in said housing wall, and a resilient diaphragm in sealingly engagement with said housing opening, the interior of said diaphragm being in fluid communication only with the interior of said housing and the exterior of said diaphragm being in fluid communication only wit the exterior of said housing, whereby the pressure on the interior and exterior of said housing will be equalized.

15. In a submersible under water vehicle having at least one housing with a wall separating the interior of said housing from ambient water surrounding said housing and one or more voids on the interior of said housing a motor within said housing and having a power shaft extending through said housing and at least one resilient seal surrounding said shaft at the point it passes through said housing wall for resisting the passage through said wall into the interior of said housing of the ambient water surrounding said housing, the improvement comprising, a liquid substantially filling said housing void, an opening in said housing wall and a resilient member in sealing engagement with said housing opening and in fluid communication with both the interior and exterior of said housing, whereby as the ambient water pressure changes said resilient member will flex and the pressure on the interior and exterior of said housing will be equalized at all depths.

16. The structure of claim 15 wherein said resilient member is a resilient tube.

17. The structure of claim 15 wherein said resilient member is a resilient diaphragm.

* * * * *